US007922050B2

(12) United States Patent
Beneš

(10) Patent No.: US 7,922,050 B2
(45) Date of Patent: Apr. 12, 2011

(54) HANDGUN HOLSTER

(76) Inventor: Miroslav Beneš, Hradec Králové (CZ)

( * ) Notice: Subject to any disclaimer, the term of this patent is extended or adjusted under 35 U.S.C. 154(b) by 727 days.

(21) Appl. No.: 12/007,682

(22) Filed: Jan. 14, 2008

(65) Prior Publication Data

US 2010/0282792 A1 Nov. 11, 2010

(30) Foreign Application Priority Data

Mar. 26, 2007 (CZ) ..... 2007-223

(51) Int. Cl.
*F41C 33/02* (2006.01)

(52) U.S. Cl. ..... 224/244; 224/192; 224/912

(58) Field of Classification Search ..... 224/192, 224/193, 198, 238, 243, 244, 911, 912
See application file for complete search history.

(56) References Cited

U.S. PATENT DOCUMENTS

| | | | | |
|---|---|---|---|---|
| 468,556 | A | 2/1892 | Anderson | |
| 1,113,530 | A | 10/1914 | Audley | |
| 1,641,439 | A | 9/1927 | Jovino | |
| 1,851,352 | A | 5/1930 | Denkert | |
| 1,951,865 | A | 3/1934 | Franz | |
| 2,551,913 | A | 5/1951 | Toby | |
| 3,630,420 | A | 12/1971 | Bianchi | |
| 4,101,060 | A | 7/1978 | Bianchi et al. | |
| 4,277,007 | A | 7/1981 | Bianchi et al. | |
| 4,694,980 | A | 9/1987 | Rogers | |
| 5,018,654 | A | 5/1991 | Rogers et al. | |
| 5,509,591 | A | 4/1996 | Carver | |
| 5,810,221 | A | 9/1998 | Beletsky et al. | |
| 5,961,013 | A | 10/1999 | Collins | |
| 6,010,045 | A * | 1/2000 | Rogers et al. | 224/198 |
| 6,588,639 | B2 * | 7/2003 | Beletsky et al. | 224/672 |
| 6,732,891 | B2 | 5/2004 | Locklear, III | |
| 6,769,582 | B1 | 8/2004 | Beletsky et al. | |
| 6,799,392 | B2 | 10/2004 | Milec et al. | |
| 6,854,626 | B2 * | 2/2005 | Liao | 224/244 |
| 7,584,875 | B2 * | 9/2009 | Lowe et al. | 224/243 |
| 2008/0179359 | A1 * | 7/2008 | Aberle et al. | 224/243 |

FOREIGN PATENT DOCUMENTS

EP 1975542 A2 10/2008

OTHER PUBLICATIONS

Czech Office Action dated Feb. 16, 2010 and partial English translation.
European Office Action dated Mar. 31, 2010.

* cited by examiner

*Primary Examiner* — Justin M Larson
(74) *Attorney, Agent, or Firm* — Buchanan Ingersoll & Rooney PC

(57) ABSTRACT

A handgun holster comprising a shaped holster body with a cavity for inserting and withdrawing the gun, which is furnished with a belt loop for attaching the holster to the belt, with a trigger guard and with a security system against removal of the gun from the holster consisting of a restraining strap to go around the gun and a release lever for that strap, mutually connected at a control point by a snap connection.

18 Claims, 9 Drawing Sheets

HANDGUN HOLSTER

FIELD OF THE INVENTION

The present invention involves a handgun holster, comprising a trigger guard and an arrangement to prevent the removal of the gun from the holster.

DESCRIPTION OF THE PRIOR ART

There has always been a need to ensure that the gun did not fall out of a handgun holster, that it did not work loose in the holster and that it could not be subject to unauthorized removal. The known standard safeguards against removal of the gun from the holster consist of covering flaps or restraining straps to go around the holstered gun. These safeguards are described and illustrated, for example, in U.S. Pat. Nos. 3,630,420, 4,694,980 and 5,018,654. To secure the gun against unauthorized removal or to prevent it from falling out of the holster, various mechanisms are used, generally with a spring-loaded catch which blocks the trigger in the trigger guard space of the gun. Typical embodiments of these holsters are disclosed, for example, in U.S. Pat. Nos. 468,556, 1,113,530, 1,851,352, 1,951,865, 4,101,060, 4,277,007, 5,018,654, 5,810,221, 6,732,891, 6,769,582, 6,799,392 etc. The object of the present invention is to provide an improved holster for revolvers and other handguns. A further object is to present a holster which will permit the user to choose one of several degrees of security for the gun in relation to any given use, and which allows the holster to be changed from the right to the left side with minimal expense, while retaining the same holster components.

SUMMARY OF THE INVENTION

The subject of this invention is an arrangement for a handgun holster comprising a shaped holster body with through cavity for inserting and withdrawing the gun, which is furnished with a belt loop for attaching the holster to the belt, with a trigger catch and with a security system against removal of the gun from the holster consisting of a restraining strap to go around the gun and the release lever of that strap, mutually connected at a control point by a snap connection. The basis of the invention lies in the fact that, in order to house the trigger catch consisting of a twin-arm lever, there is an identical, facingly arranged socket in each of the two side walls of the holster body, having in its lower part a through opening for housing the operational part of the lever for securing the gun trigger so that, in the secured operating position, the trigger catch of the holster is depressed by a spring into the interior through cavity of the holster where, in this position, it rests on the first bearing surface of the socket and, in the released operating position under the pressure of the spring, in which the operational part of the lever fits against the surface of the through cavity of the holster, it rests on the second bearing surface of the socket, and where the upper control part of the lever of the trigger catch protrudes from the socket outside the side wall of the holster body in the direction of the holster belt loop in a position under the control point of the security system against removal of the gun from the holster, whilst the side walls of the body of the holster are specularly arranged and are furnished with covers attached thereto, to individually attach the security system against removal of the gun from the holster to the side walls of the body of the holster and to hide the operational part of the lever of the trigger catch. The two side walls of the body of the holster are reinforced in the area of the socket, whilst their thickness in that area corresponds to the thickness of the operational part of the lever of the trigger catch. In the rear wall of the body of the holster there is an upwardly open slot to facilitate the insertion and withdrawal of the gun.

The operational part of the lever has a recess on the outer side, in which is located a spring on a pin which forms the fulcrum of the lever of the trigger catch and which is positioned with its ends in the corresponding reinforced part of the side wall of the body of the holster. The first bearing surface of the socket is perpendicular to the second bearing surface of the socket.

The covers of the side walls of the body of the holster consist of plates whose inner sides are furnished with two identical, symmetrical, adjacently arranged locking recesses for alternative clamping of the correspondingly shaped ends of the restraining strap or the release lever of the restraining strap from one side or the other of the inner side of the cover.

In another embodiment of this invention, the covers of the side walls of the body of the holster consist of plates whose inner sides are furnished with two identical, symmetrical, adjacently arranged recesses for guiding the restraining strap or the release lever of the restraining strap from one side or the other of the inner side of the cover, whilst for setting and securing the resulting position, the restraining strap and the side walls of the body of the holster are furnished with projections on the outer sides of their corresponding parts.

The embodiment of the holster discloses an open modular system which takes advantage of all the existing structural elements and at the same time offers room for the use of newly proposed complementary elements. With appropriate selection of the complementary components, the design permits concealed use of the holster as a belt service holster as well as an embodiment for use with the lower installed thigh belt loops used by special units. The advantage of this system lies in the simplicity, precision and adaptability of the parts for various holster assemblies according to the needs of the user. It meets user requirements for extension and complementary holster elements in right and left assemblies, with uniform parts for these two alternative uses. The user can choose his/her own combination of safety elements according to the intended use of the holster.

The front wall of the body of the holster has a guide groove for the gun sights, on the inside and running from top to bottom of said front wall, which guides and adjusts the position of the gun in the holster during insertion and withdrawal. The shape of the guide groove protects the sights against impairment or damage during manipulation of the gun in the holster and at the same time increases the rigidity of the front wall of the body of the holster.

Attached to the lower part of the back wall of the body of the holster is a delineative part which projects, with its spring-loaded tab part, into the through cavity of the holster. It serves to limit undesirable play especially of the gun in the holster.

The belt loop can be furnished with three rows of oval through openings with stops to permit adjustable fastening to the body of the holster, whilst each row comprises three mutually connected round holes. The belt loop can be furnished with a body armrest.

BRIEF DESCRIPTION OF THE DRAWINGS

The invention may be more clearly understood by reference to the drawings and the following description of preferred embodiments.

FIG. 6 shows the twin-arm lever of that catch in the secured operating position, depressed by a spring into the interior through cavity of the holster in the area of the trigger catch of the holster where, in that position, it rests on the first bearing surface of the socket. FIG. 7 shows the lever of the trigger catch in the released operating position under the pressure of the spring, in which the operational part of the lever of the trigger catch fits against the surface of the through cavity of the holster and where the trigger catch rests on the second bearing surface of the socket.

EXAMPLES OF PREFERRED EMBODIMENTS

Figure 1:
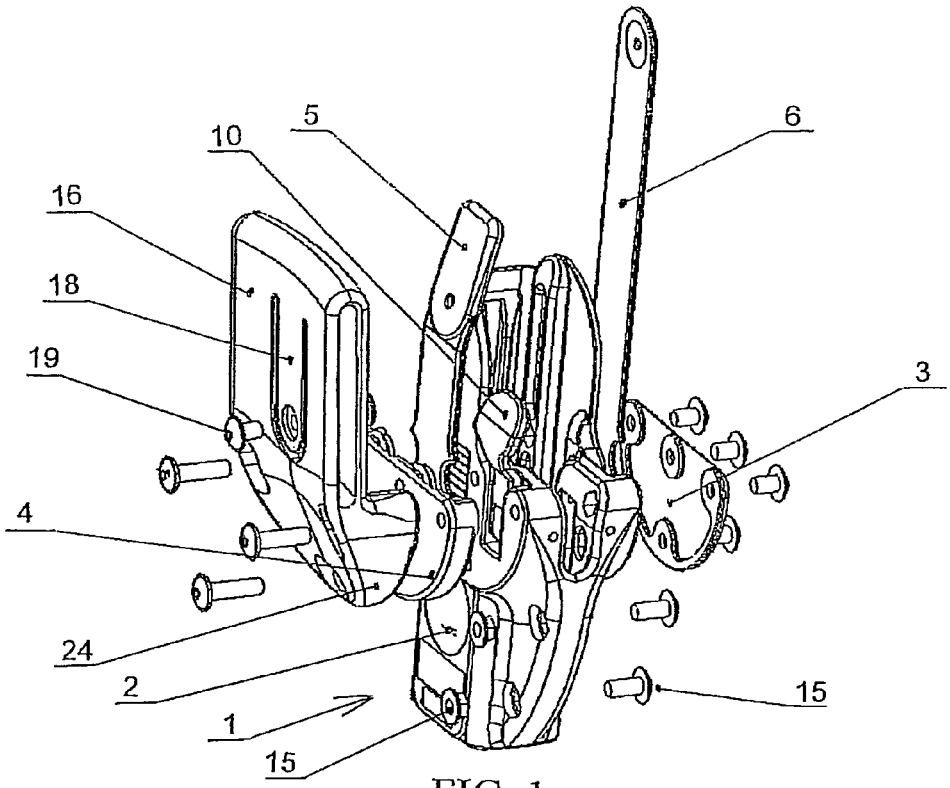
FIGS. 1, 2 and 3 show a disassembled holster with belt loop according to this invention, viewed from both sides and from below.
Figure 2:
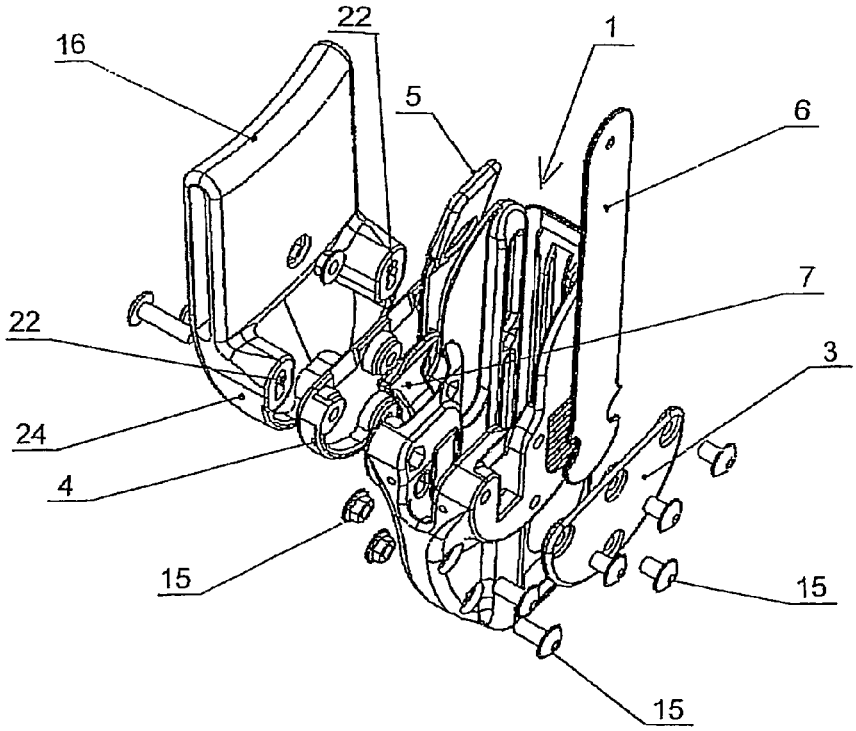
Figure 3:
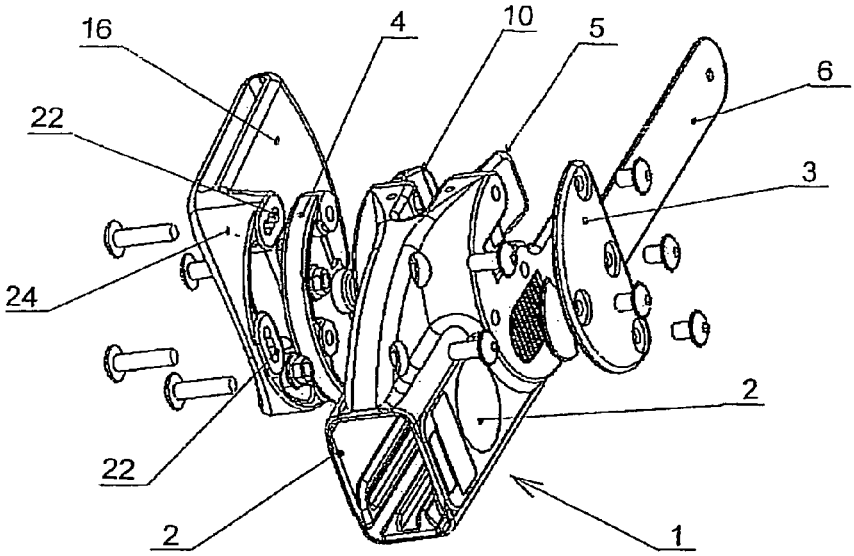
Figure 4:
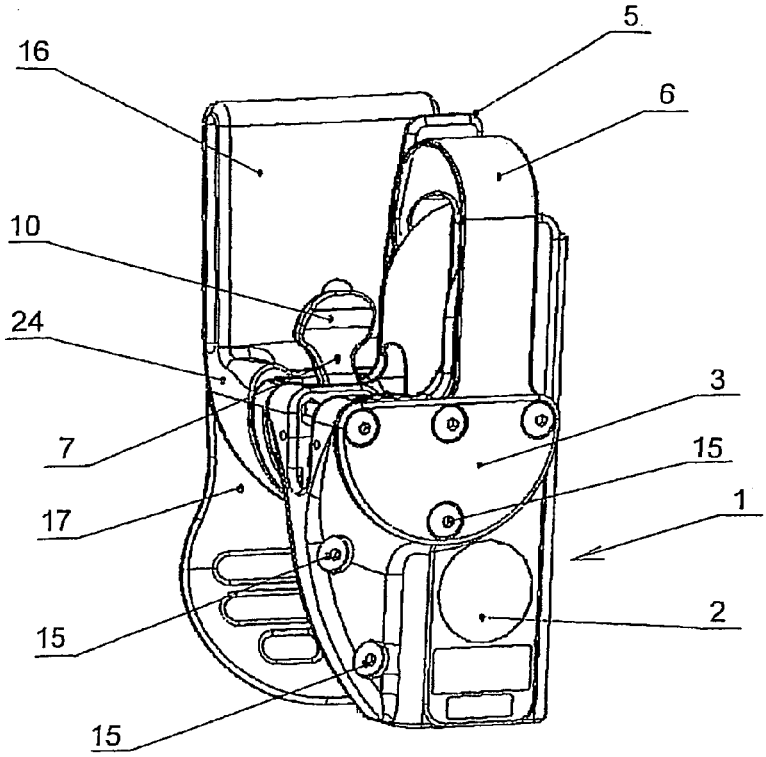
FIG. 4 shows the assembly of the holster with belt loop and body armrest.
Figure 5:
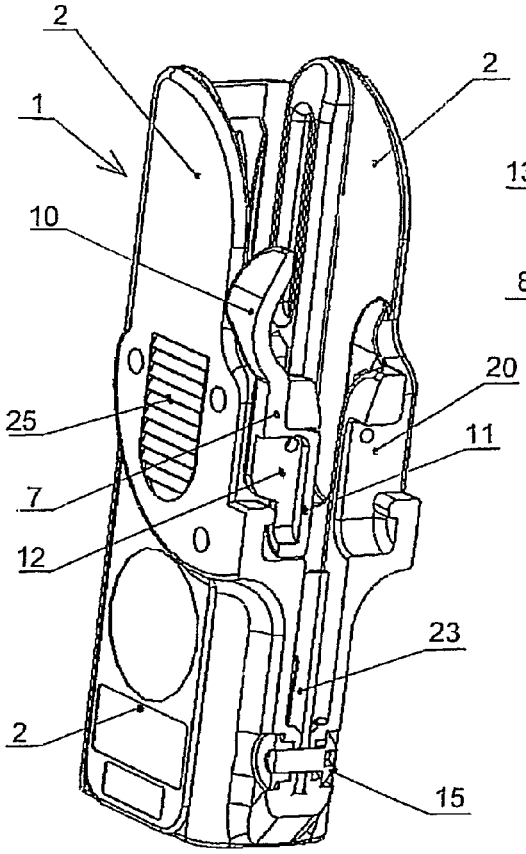
FIG. 5 shows the body of the holster in cross section, intersecting the socket in each of the two side walls of the body of the holster, where the trigger catch of the holster is inserted in the left socket. In the left side wall of the body of the holster are projections for gripping the restraining strap or the release lever of that strap, providing security against removal of the gun from the holster.
Figure 6:
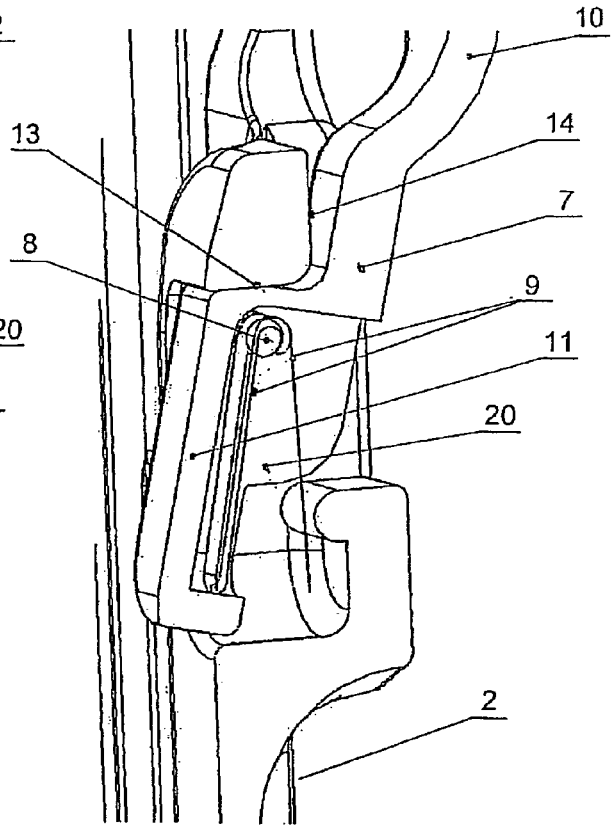
FIGS. 6 and 7 show details of the positioning of the trigger catch of the holster in the socket.
Figure 9:
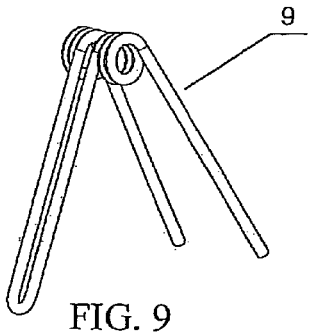
In FIG. 9 there is an example of an embodiment of one possible shape for the spring of the trigger catch of the holster.
Figure 7:
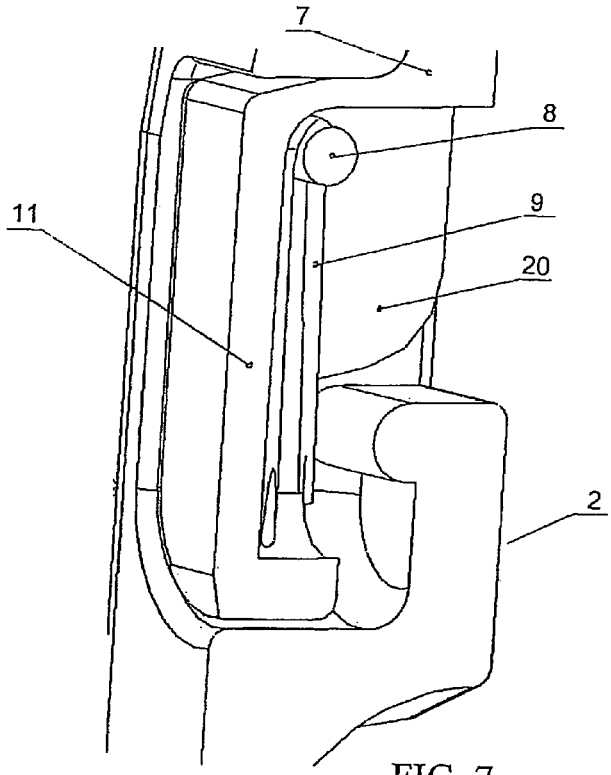
Figure 8:
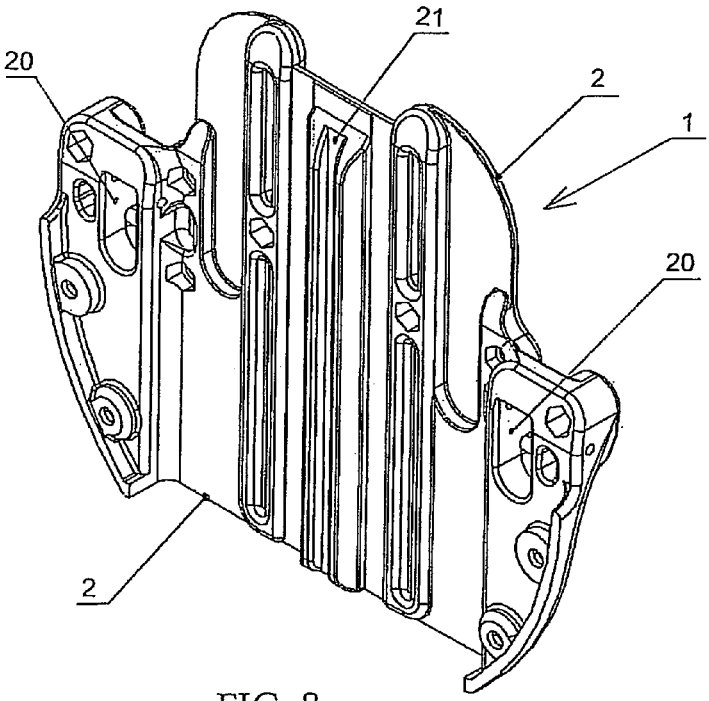
FIG. 8 shows an embodiment of the moulding of the plastic body of the holster, before flection and subsequent joining of its side walls into the final shape, thus creating the through cavity for inserting and withdrawing the gun. In the areas of the sockets the two side walls of the body of the holster are reinforced so that their thickness in that area corresponds to the thickness of the operational part of the lever of the trigger catch.
Figure 10:
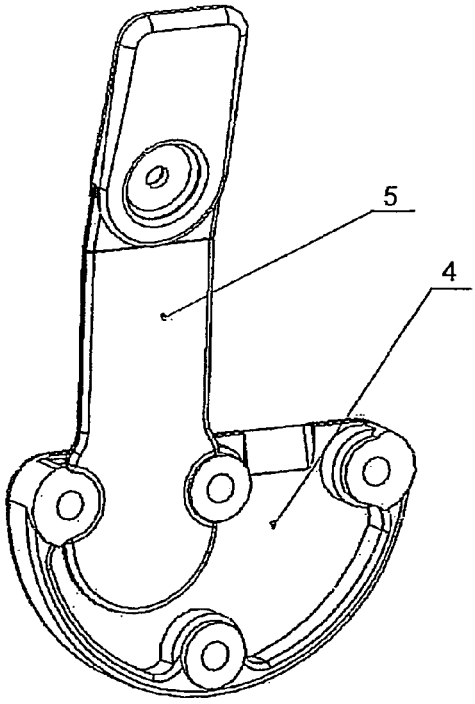
FIGS. 10 and 11 show one of the possible embodiments of a cover for one of the side walls of the body. It is illustrated as a semi-circular plate whose inner side is furnished with two identical, symmetrical, adjacently arranged locking recesses for alternative clamping of the correspondingly shaped ends of the restraining strap or the release lever of the restraining strap from one side or the other of the inner side of the cover.
Figure 11:
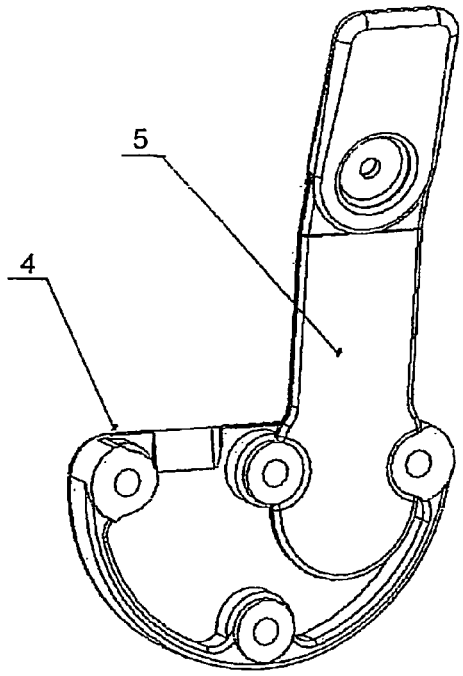
Figure 12:
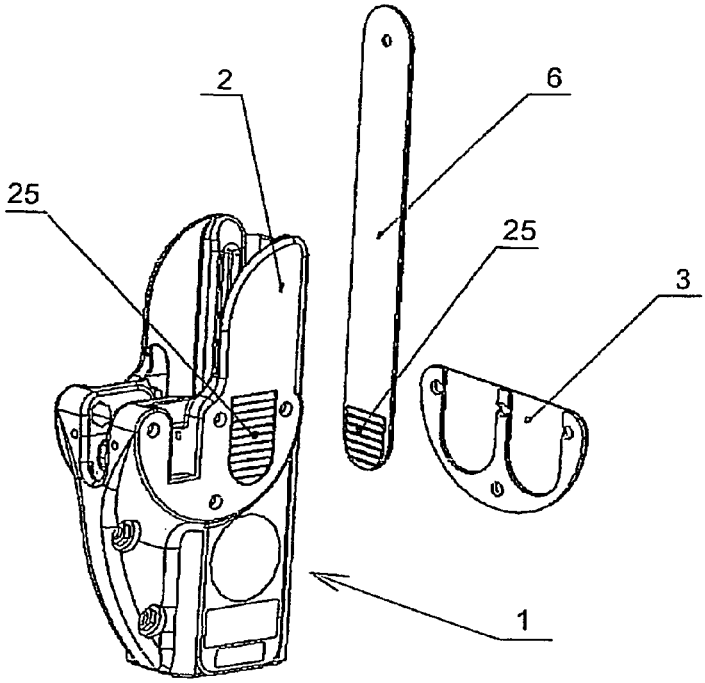
FIG. 12 shows the assembly of the body of the holster, whose side wall is furnished with projections for gripping the restraining strap, which is also furnished in its end part with complementary projections. Also illustrated is the relevant cover of the side wall with restraining strap, whose inner side is furnished with two identical, symmetrical, adjacently arranged recesses for guiding the restraining strap before its attachment to the side wall of the body of the holster.
Figure 13:
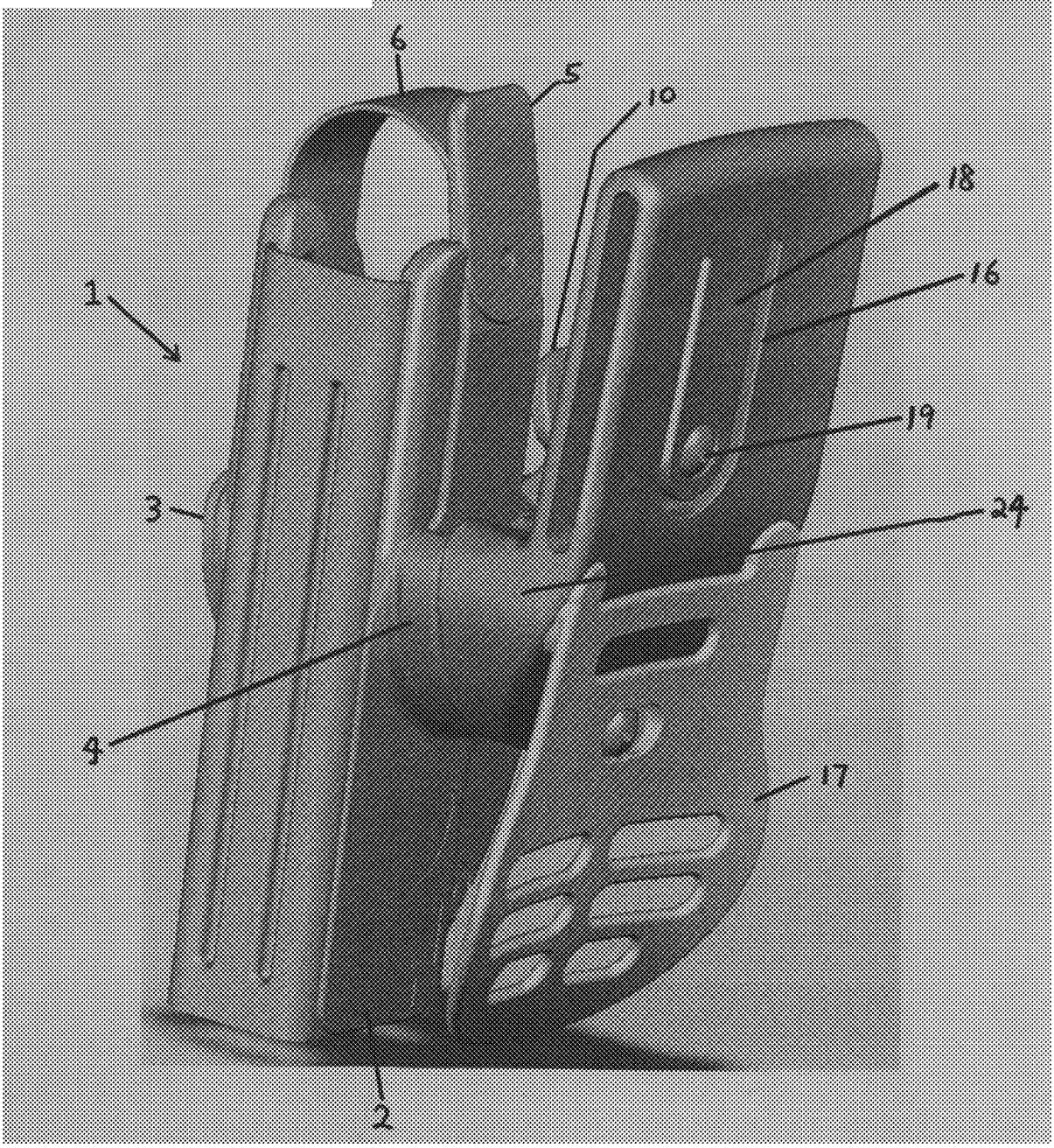
FIG. 13 presents a lateral view of the assembly of the holster with its belt loop and body armrest, FIG. 14 presenting the view from underneath.
Figure 14:
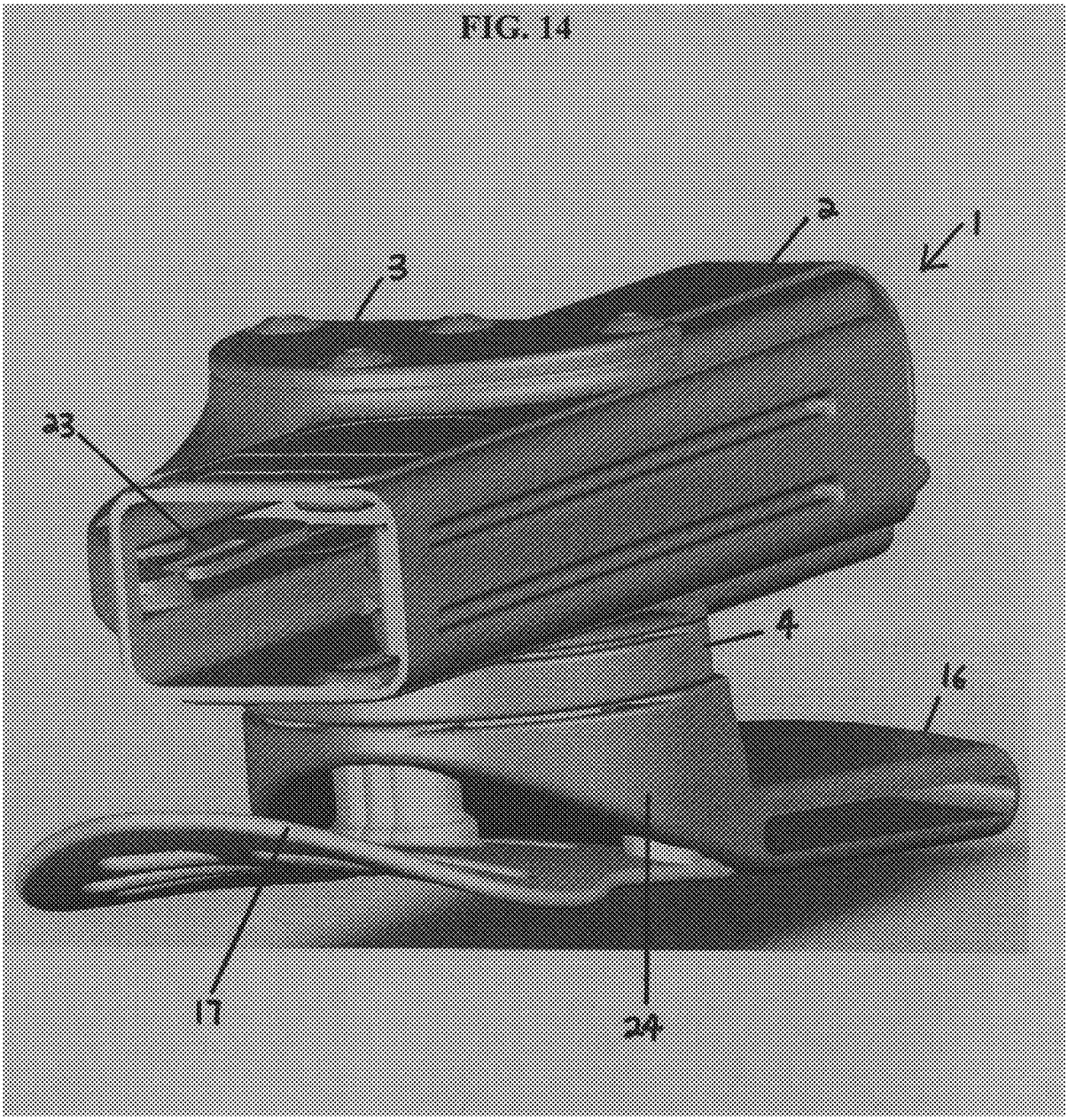
Figure 15:
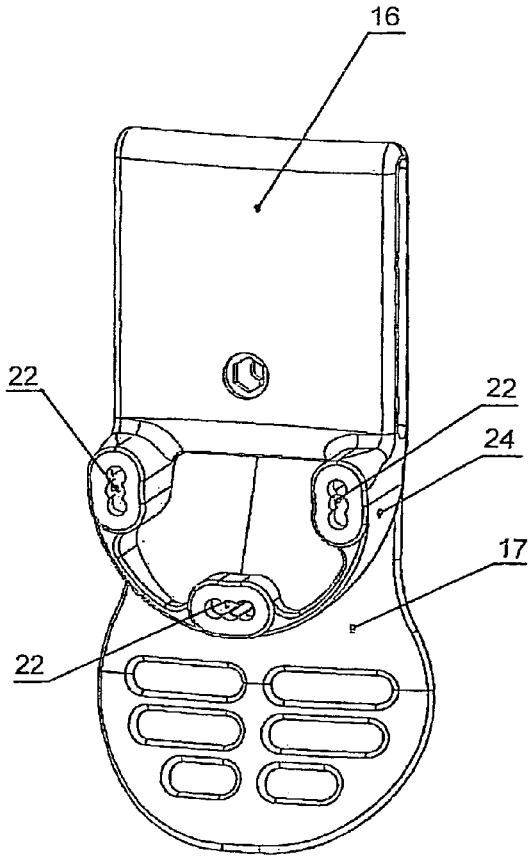
In FIGS. 15 and 16 the assembly of one possible embodiment of the belt loop of the holster and the body armrest is shown in front and back view.
Figure 16:
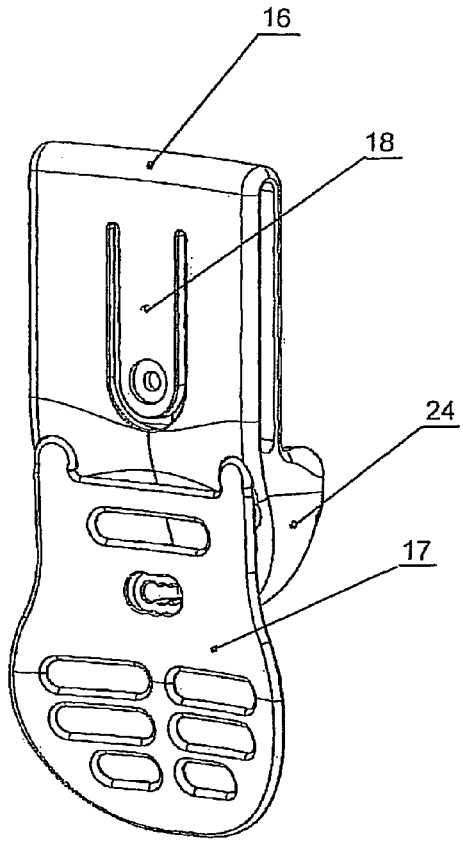
Figure 17:
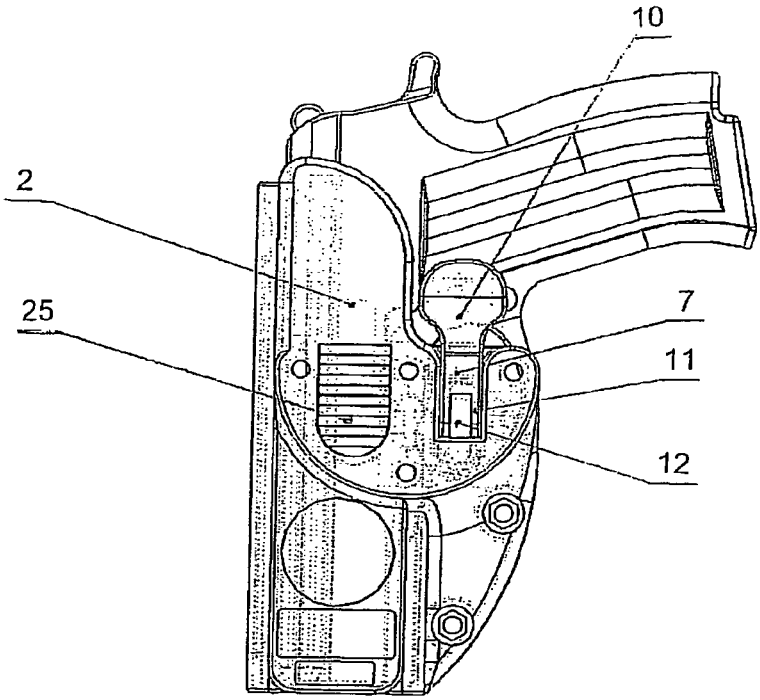
FIGS. 17 and 18 represent views from each lateral side of the holster body with inserted gun, half of the trigger guard of the gun is seen, where the operational part of its lever extends into the area of the trigger guard of the gun.
Figure 18:
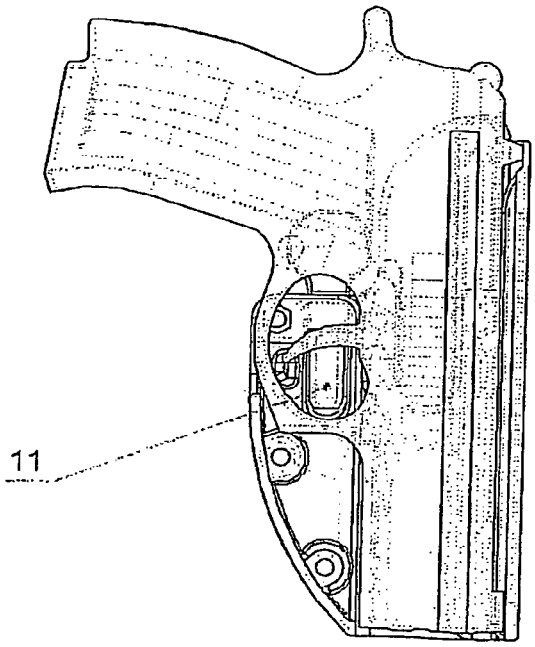

The handgun holster comprises a shaped body 1 made of plastic, with a through cavity for inserting and withdrawing the gun. In the rear wall of the body 1 of the holster, there is an upwardly open slot to facilitate the insertion and withdrawal of the gun.

The body 1 of the holster is furnished with a trigger catch 7 and with a security system against removal of the gun from the holster including a plastic, flexible, flat restraining strap 6 to go around the gun and a plastic release lever 5 for that strap 6, mutually connected at a control point by a snap connection, for example a compression rivet. By unfastening the restraining strap 6 and the release lever 5, the user of the gun can deflect the release lever 5 to the side, away from the body 1 of the holster to the belt loop 16. The compression rivet is thereby unfastened and the restraining strap 6 is released. Security against withdrawal of the gun is provided by the opposite procedure, by snapping the compression rivet, by the pressure of the release lever 5, against the other part of the clasp on the restraining strap 6. The control element of the security system so described is the release lever 5.

The plastic trigger catch 7 of the holster includes a twin-arm lever comprising the operational part 11 of the lever and the control part 10 of the lever. To house the trigger catch 7 of the holster, in each of the two side walls 2 of the holster body 1 there is an identical, facingly arranged socket 20 having in its lower part a through opening for housing the operational part 11 of the lever for securing the gun trigger. The two side walls 2 of the body 1 of the holster are reinforced in the area of the socket 20, whilst their thickness in that area corresponds to the thickness of the operational part 11 of the lever of the trigger catch 7. The operational part 11 of the lever has a recess on the outer side, in which is located a spring 9 on a pin 8 which forms the fulcrum of the lever of the trigger catch 7 and which is positioned with its ends in the corresponding reinforced part of the side wall 2 of the body 1 of the holster.

In the secured operating position, the trigger catch 7 of the holster is depressed by a spring 9 into the interior through cavity of the holster in the area of the trigger guard where, in this position, it rests on the first bearing surface 13 of the socket 20. In the released operating position under the pressure of the spring 9, in which the operational part 11 of the lever fits against the surface of the through cavity of the holster, the trigger catch rests on the second bearing surface 14 of the socket 20. The first bearing surface 13 of the socket 20 is perpendicular to the second bearing surface 14 of the socket 20. The upper control part 10 of the lever of the trigger catch 7 protrudes from the socket 20 outside the side wall 2 of the holster body 1 in the direction of the holster belt loop 16 in a position under the control point of the security system against removal of the gun from the holster (under the snap connection of the restraining strap 6 which goes around the gun and the release lever 5 of that strap 6). The control part 10 of the lever of the trigger catch 7 is comfortable to use, having the ergonomic shape of an axially deflected and extended blade, which permits control in all modes of year-round use of the holster. The shape of the control part 10 of the lever of the trigger catch 7 also permits use of this security element as a dual trigger catch, that is with the thumb and index finger at the same time, and that in all modes of use of the holster. It is also possible to use each of them independently, without limiting the functionality of whichever part is used. The advantage of this accessory, safety and at the same time security element lies in the ease of assembly and serviceability for the desired type of security system. It is an advantage that the trigger catch 7 includes the same uniform assembly part for thumb and index finger embodiments. This two-stage gun security system is simple and safe, release of the two trigger catches 7 (located on both side walls 2 of the body 1 of the holster) proceeds at the same time, essentially automatically, while grasping the gun in the holster with the thumb and index finger of the left or right controlling hand as the case may be, or sequentially in whichever order is chosen.

An important feature of this invention is that the side walls 2 of the body 1 of the holster are specularly arranged and are furnished with plastic covers (3, 4) attached thereto, to individually attach the security system against removal of the gun from the holster to the side walls 2 of the body 1 of the holster and to hide the operational part 11 of the lever of the trigger catch 7. The covers 3, 4 of the side walls 2 of the body 1 of the holster consist of semi-circular plates whose inner side is furnished with two identical, symmetrical, adjacently arranged locking recesses for alternative clamping of the correspondingly shaped ends of the restraining strap 6 or the release lever 5 of the restraining strap 6 from one side or the other of the inner side of the covers 3, 4.

In an alternative embodiment of this invention the inner sides of the semi-circular covers 3, 4 are furnished with two identical, symmetrical, adjacently arranged recesses for guiding the restraining strap 6 or the release lever 5 of the restraining strap 6 from one side or the other of the inner side of the covers 3, 4, whilst for setting and securing the resulting position, the restraining strap 5 and the side walls 2 of the body 1 of the holster are furnished with projections 25 on the outer sides of their corresponding parts.

This kit of uniform parts for the holster permits a high degree of variability depending upon the intended use and requirements of the user. It is possible, quite simply and without the need for modification and further parts, to arrange a right-hand holster on the left, and vice-versa. This is economically advantageous, particularly in armed units where individual membership is constantly changing and therefore also the ratio of right- to left-handed members. A further economic advantage is the basic simplification of logistical security, as it is not necessary to stock and keep separate records of supply items for right and left-handed members. The multi-functional holster according to this invention, with loop-belt 16, trigger catch 7 and restraining strap 6, permits not only user modification of the holster from right to left side and vice-versa, but also easy dismantling of the trigger catch 7 or restraining strap 6 so that it is possible to select only one of these security systems. That may be preferable for members of special units where one security system is sufficient and speed of use is favoured over multiple safety measures. A further possible modification in the function of the holster is the replacement of the thumb trigger catch 7 by an index finger trigger catch 7. That modification can be carried out easily and quickly by simply transferring the thumb trigger catch 7 (including its spring 9 and pin 8) to the opposite side wall 2 of the holster.

The front wall of the body 1 of the holster has a guide groove 21 for the gun sights, on the inside and running from top to bottom of said front wall. The integrated guide so formed for the sights guides and adjusts the position of the gun in the holster during insertion and withdrawal, and protects the sights against damage during manipulation of the gun in the holster. The shape of the guide for the sights, with the protruding side walls of the guide groove 21 running from top to bottom of the holster, together with the bend in the original flat mould of the body 1 of the holster part in the grooves located on the inner side of the mould of the body 1 of the holster along both sides of the guide for the sights, increases the rigidity of the holster. By this flection of the body 1 of the holster and joining of its side walls 2 by means of the connecting elements 15 (sunken screws and nuts) through the lower border of the rear wall so formed of the body 1 of the holster, the desired rigidity and shape stability of the holster is achieved.

Attached to the lower part of the back wall of the body 1 of the holster is the plastic disk of a delineative part 23 for limiting undesirable play especially of the gun in the holster, which projects, with its spring-loaded tab part, into the through cavity of the holster. After insertion of the gun into the holster, the delineative part 23 is in contact with the barrel of the gun and its spring-loaded tab part presses the gun against the front wall of the inner cavity of the holster on the flat edge of the protruding side walls of the guide groove 21 for the gun sights. On withdrawal of the gun from the holster, the spring-loaded tab returns to its original position. Two round holes serve for attachment to the principle part. The delineative part 23 is inserted between the two side walls 2 of the closed body 1 of the holster and the two connecting elements 15 fastened to it (to the body 1 of the holster by sunken screws and nuts), which also draws the body 1 of the holster together into a single unit and ensures the rigidity and desired shape of the holster.

The holster is furnished with a belt loop 16 made of plastic for attaching the holster to the belt. The basic parts of the belt loop 16 are standard embodiments. They comprise a compact body with closed suspension eye for threading onto the user's belt and an integral reinforced downward projection 24 fixing the belt loop to the body 1 of the holster (for example by means of one of the covers 3, 4 of the relevant side wall 2). In the wall of the suspension eye on the side next to the user's body, there is a pressure arresting element (the tab 18 of the holster belt loop, basically a belt brake with inner arresting screw 19) which prevents free movement of the holster along the belt. By tightening this arresting screw 19, the play of the belt loop 16 is limited according to the width of the belt used, and the holster is secured in the desired position on the belt.

According to this invention the projection 24 allowing for adjustable fastening of the belt loop 16 to the body 1 of the holster is furnished with three rows 22 of oval through openings with stops. Each row 22 comprises three mutually connected round holes. A shaped plastic body armrest 17 is attached to the projection 24 of the body of the holster 16. This ergonometrically designed part with lengthwise oval weight-reducing openings assures the stability of the holster while suspended on the belt and also distributes the weight of the gun carried in the holster. Connection of the armrest 17 to the belt loop 16 is effected by means of connecting elements (sunken screws) and by delimiting projections in the upper part of the armrest 17. Depending upon the geometry of its execution in relation to the gun user's body belt, the belt loop 16 can be a so-called belt or below-belt embodiment.

The described embodiments illustrate the principles of this invention and are non-restrictive. The scope of this invention is determined by the scope of the following claims, including their equivalents.

INDUSTRIAL USE

The handgun holster according to this invention allows for simple adjustment, without the need for modification and further parts, as a right-hand or left-hand holster and vice-versa according to the intended use and requirements of the user. It also allow the user to choose one or more safeguards for the gun in the holster, again according to the specific intended use of the gun.

List of reference numerals

| | |
|---|---|
| 1 | body of holster |
| 2 | side wall of body 1 of holster |
| 3 | first cover of side wall 2 |
| 4 | second cover of side wall 2 |
| 5 | release lever of restraining strap 6 |
| 6 | restraining strap |
| 7 | trigger guard |
| 8 | pin of trigger guard |

-continued

| List of reference numerals | |
|---|---|
| 9 | spring of trigger guard 7 |
| 10 | control part of lever of trigger guard |
| 11 | operational part of lever of trigger guard |
| 12 | recess of operational part 11 of lever of trigger guard 7 (for inserting spring 9) |
| 13 | first bearing surface of side wall 2 and control part 10 of lever of trigger guard 7 |
| 14 | second bearing surface of side wall 2 and control part 10 of lever of trigger guard 7 |
| 15 | connecting elements |
| 16 | holster belt loop |
| 17 | armrest of holster belt loop 16 |
| 18 | tab of holster belt loop 16 |
| 19 | arresting screw for belt |
| 20 | socket |
| 21 | groove for guiding gun sights |
| 22 | row of oval through openings in belt loop 16 |
| 23 | delineative part |
| 24 | projection of body of belt loop 16 |
| 25 | projections |

The invention claimed is:

1. A handgun holster including a security system comprising:

a shaped holster body including two side walls and a cavity therebetween for inserting and withdrawing a gun, wherein each side wall includes a facingly arranged socket, each socket having a through opening having a first bearing surface and a second bearing surface;

a trigger catch formed by a twin-arm lever and including a control part and an operational part which secures the gun's trigger guard, the through opening housing the operational part of the lever; and a spring;

wherein the spring biases the trigger catch into a secured position in which the operational part abuts the first bearing surface of the through opening of one socket in order to secure the gun's trigger guard, the control part of the trigger catch being biased in a direction opposite that of the operational part;

wherein upon activation of the control part the operational part of the trigger catch abuts the second bearing surface of the one socket in a released operating position; and wherein the trigger catch is transferable from one socket to the other to allow activation of the control part from an opposite side of the holster.

2. A handgun holster security system, comprising:

a restraining strap for restraining a portion of handgun from being removed from a holster;

a release lever connected to the restraining strap at a control point to release the strap so the handgun may be removed from the holster;

a shaped holster body including two side walls and a cavity therebetween for inserting and withdrawing a gun, wherein each side wall includes a facingly arranged socket, each socket having a through opening having a first bearing surface and a second bearing surface;

a trigger catch formed by a twin-arm lever and including a control part and an operational part which secures the gun's trigger guard, the through opening housing the operational part of the lever; and a spring;

wherein the spring biases the trigger catch into a secured position in which the operational part abuts the first bearing surface of the through opening of one socket in order to secure the gun's trigger guard, the control part of the trigger catch being biased in a direction opposite that of the operational part;

wherein upon activation of the control part, the operational part of the trigger catch abuts the second bearing surface of the one socket in a released operating position; and wherein the trigger catch is transferable from one socket to the other to allow activation of the control part from an opposite side of the holster.

3. The handgun holster security system according to claim 2, wherein the release lever is connected to the restraining strap by a snap connection.

4. The handgun holster security system according to claim 2, further comprising:

a pair of holster body covers including plates whose inner sides are furnished with two symmetrical, adjacently arranged locking recesses for alternative clamping of the correspondingly shaped ends of either the restraining strap or the release lever from one side of a holster or the other.

5. The handgun holster security system according to claim 4, wherein the locking recesses are identical.

6. A handgun holster, including a handgun holster security system, comprising:

a restraining strap for restraining a portion of handgun from being removed from a holster;

a release lever connected to the restraining strap at a control point to release the strap so the handgun may be removed from the holster;

a shaped holster body including two side walls and a cavity therebetween for inserting and withdrawing a gun, wherein each side wall includes a facingly arranged socket, each socket having a through opening having a first bearing surface and a second bearing surface;

a trigger catch formed by a twin-arm lever and including a control part and an operational part which secures the gun's trigger guard, the through opening housing the operational part of the lever; and a spring;

wherein the spring biases the trigger catch into a secured position in which the operational part abuts the first bearing surface of the through opening of one socket in order to secure the gun's trigger guard, the control part of the trigger catch being biased in a direction opposite that of the operational part;

wherein upon activation of the control part, the operational part of the trigger catch abuts the second bearing surface of the one socket in a released operating position; and wherein the trigger catch is transferable from one socket to the other to allow activation of the control part from an opposite side of the holster.

7. The handgun holster according to claim 6, wherein the first bearing surface of each socket is perpendicular to the second bearing surface of the respective socket.

8. A handgun holster according to claim 6, wherein a front wall of the body of the holster has a guide groove, on the inside and running from top to bottom of said front wall for receiving gun sights.

9. The handgun holster according to claim 6, wherein the two side walls of the body of the holster are reinforced in the area of the sockets.

10. The handgun holster according to claim 9, wherein the operational part of the trigger catch has a recess on an outer side, said spring being located in the recess on a pin which forms the fulcrum of the lever of the trigger catch and which is positioned with its ends in the corresponding reinforced part of the side wall of the body of the holster.

11. The handgun holster according to claim 6, wherein a rear wall of the body of the holster comprises an upwardly open slot to facilitate the insertion and withdrawal of the gun.

12. The handgun holster according to claim 11, wherein attached to the lower part of the rear wall of the body of the holster is a delineative part which projects, with a spring-loaded tab part, into the cavity of the holster.

13. The handgun holster according to claim 6, further comprising:

a belt loop for attaching the holster to a user's belt.

14. The handgun holster according to claim 13, wherein the belt loop is furnished with three rows of oval through openings with stops to permit adjustable fastening to the body of the holster, while each row comprises three mutually connected round holes.

15. The handgun holster according to claim 13, wherein the belt loop is furnished with a body armrest.

16. The handgun holster according to claim 6, further comprising:

a pair of holster body covers including plates whose inner sides are furnished with two symmetrical, adjacently arranged locking recesses for alternative clamping of correspondingly shaped ends of either the restraining strap or the release lever from one side of the holster or the other.

17. The handgun holster according to claim 16, wherein the restraining strap and the side walls of the body of the holster are furnished with respective projections on their outer sides, for setting and securing a resulting position.

18. The handgun holster according to claim 16, wherein the locking recesses are identical.

* * * * *